United States Patent [19]

Kalyandurg

[11] Patent Number: 5,066,981

[45] Date of Patent: Nov. 19, 1991

[54] MECHANISM FOR RESPONSIVELY SPACING A DEVELOPMENT ROLLER

[75] Inventor: Satyan R. Kalyandurg, Rochester, N.Y.

[73] Assignee: Eastman Kodak Company, Rochester, N.Y.

[21] Appl. No.: 597,137

[22] Filed: Oct. 15, 1990

[51] Int. Cl.[5] ..... G03G 15/06

[52] U.S. Cl. ..... 355/245; 118/645; 118/657; 355/251; 355/326

[58] Field of Search ..... 355/245, 251, 326, 259, 355/327; 118/645, 656, 657, 658, 681, 661

[56] References Cited

U.S. PATENT DOCUMENTS

| | | | |
|---|---|---|---|
| 3,854,449 | 12/1974 | Davidson | 118/637 |
| 4,797,708 | 1/1989 | Kasiske et al. | 355/245 X |
| 4,827,305 | 5/1989 | Enoguchi et al. | 355/259 |
| 4,891,674 | 1/1990 | Seyfried | 355/245 |

*Primary Examiner*—A. T. Grimley
*Assistant Examiner*—Thu Anh Dang
*Attorney, Agent, or Firm*—Tallam I. Nguti

[57] ABSTRACT

A mechanism for responsively spacing the development roller of an electrostatographic development apparatus from an image-bearing surface consists of a generally triangular member. The triangular member includes a development-roller mounting aperture at the apex thereof, a scavenging-device mounting slot near the base, and flat portions at the base for contacting and riding on a pair of image-bearing-surface backup rollers.

8 Claims, 3 Drawing Sheets

MECHANISM FOR RESPONSIVELY SPACING A DEVELOPMENT ROLLER

CROSS-REFERENCE TO A RELATED APPLICATION

This application is related to U.S. application Ser. No. 07/597,135, filed here on even date in the name of the same inventor, and entitled "DEVELOPMENT APPARATUS HAVING A PLATE SCAVENGING DEVICE".

BACKGROUND OF THE INVENTION

1. Field of the Invention

The present invention relates to electrostatographic copiers and printers, and more particularly, to a mechanism for responsively and precisely spacing the development roller of a development apparatus from the image-bearing surface of a copier or printer.

2. Background of the Invention

The process of producing or reproducing copies of images in an electrostatographic copier or printer involves moving an imaging member, in the form of a rigid drum or flexible web, past a series of process stations. As this occurs, the imaging member is first charged, and then imagewise exposed to form a latent electrostatic charge image thereon. The latent image is thereafter developed or made visible by moving it past a development station or apparatus where charged, pigmented toner particles, from development material held in a sump portion at the development station, are attracted to the latent image charges. The developed or toner image is subsequently transferred, at a transfer station, to a suitable receiver, such as a copy sheet of paper which is thereafter advanced through a fusing station. At the fusing station, the toner particles on the copy sheet, particularly those forming the desired image, are heated and fused. Meantime, any particles remaining on the imaging member are thereafter removed, at a cleaning station using a cleaning apparatus such as a fiber brush, prior to again reusing the imaging member as above to form and transfer images.

The development material being held in the sump portion at the development station or apparatus may be single component in that it consists entirely of toner particles, or it may be multiple component. Multiple component, for example two-component developer material may consist of an admixture of toner particles and carrier particles. Where the development station or apparatus is holding multiple component developer material, the carrier particles are usually stirred together with the toner particles in order to triboelectrically charge both types of particles.

The charged developer material, consisting of such charged particles, is then moved within the development station by means including a development roller so as to bring the toner particles into transfer proximity with the latent image on the image-bearing member. The resulting transfer of the toner particles to the image on the image-bearing member constitutes the development step of electrostatographic process as described above.

As is well known in the art, the effectiveness and quality of such image development depends, in great part, on the preciseness and constancy of the spacing between the surface of the development roller and that of the image-bearing member.

As disclosed in commonly assigned U.S. Pat. Nos. 4,926,198, issued May 15, 1990, and No. 4,806,991, issued Feb. 21, 1989, it is well known to use back-up rollers or ski rods on the backside of the image-bearing member for positioning the image-bearing surface thereof at a desired spacing from the development roller of a development station or apparatus. Typically, a pair of parallel back-up rollers or ski rods is used. The rollers or ski rods are rotatable and are frictionally rotated by the moving image-bearing member. The development apparatus containing the development roller usually is mounted on float means such as springs, and mechanically positioned so as to be precisely spaced from the plane of the image-bearing member.

Unfortunately, however, undesirable variations will occur in the positioning of the plane of the image-bearing member as formed by the back-up rollers or ski rods. Such variations may be due, for example, to the ski rods being out of parallel with each other, or to a tilt or skew therein caused by the moving image-bearing member or film. If not corrected as precisely as possible, such variations will, of course, result in non-uniform and, hence, poor quality toner image development. Furthermore, if such variations are not corrected, they will detrimentally affect the effectiveness of a DPU scavenging device that is positioned as disclosed in related U.S. application Ser. No. 07/597,135, filed here on even date in the name of the same inventor, and entitled "DEVELOPMENT APPARATUS HAVING A PLATE SCAVENGING DEVICE".

SUMMARY OF THE INVENTION

It is an object of the present invention to provide, in a copier or printer, a mechanism for precisely and responsively spacing the development roller of a development apparatus from the image-bearing surface of such copier or printer.

It is a further object of the present invention to provide, in a copier or printer, means for mounting a carrier particle scavenging device precisely and responsively spaced between the image-bearing surface of the copier or printer and the development roller of a development apparatus in such copier or printer.

In accordance with the present invention, a spacing mechanism is provided in an electrostatographic copier or printer for precisely and responsively spacing the development roller of a development apparatus of such copier or printer from the frontside of the image-bearing member or film of the copier or printer. The copier or printer, as such, has a flexible image-bearing member or film for electrostatically forming latent images on the frontside thereof and at least a development apparatus positioned adjacent the frontside of the film and including a development roller for developing the latent images using toner particles.

The spacing mechanism includes first and second backup rollers or ski rods for forming a film plane generally parallel to a plane tangential to the development roller of the development apparatus. The backup rollers or ski rods are mounted spaced side-by-side from each other, in contact with the backside of the film, and across from the development roller of the development apparatus.

The spacing mechanism also includes spring means connected to the frame of the copier or printer for supporting the development apparatus urgeably toward or away from the frontside of the image-bearing member of film. Further, the spacing mechanism includes a pair of generally triangular members which precisely space the development roller from the first and second backup rollers or ski rods. Each triangular member is mounted at an end of the development roller. As mounted, each triangular member acts against the force of the spring means, and simultaneously contacts the first and second backup rollers or ski rods so as to move the development roller responsively to any movement of the backup rollers or ski rods and, hence, responsively to movement of the frontside of the film or image-bearing member.

BRIEF DESCRIPTION OF THE DRAWINGS

In the detailed description of the invention presented below, reference is made to the accompanying drawings, in which.

DETAILED DESCRIPTION OF THE PREFERRED EMBODIMENT

Figure 1:
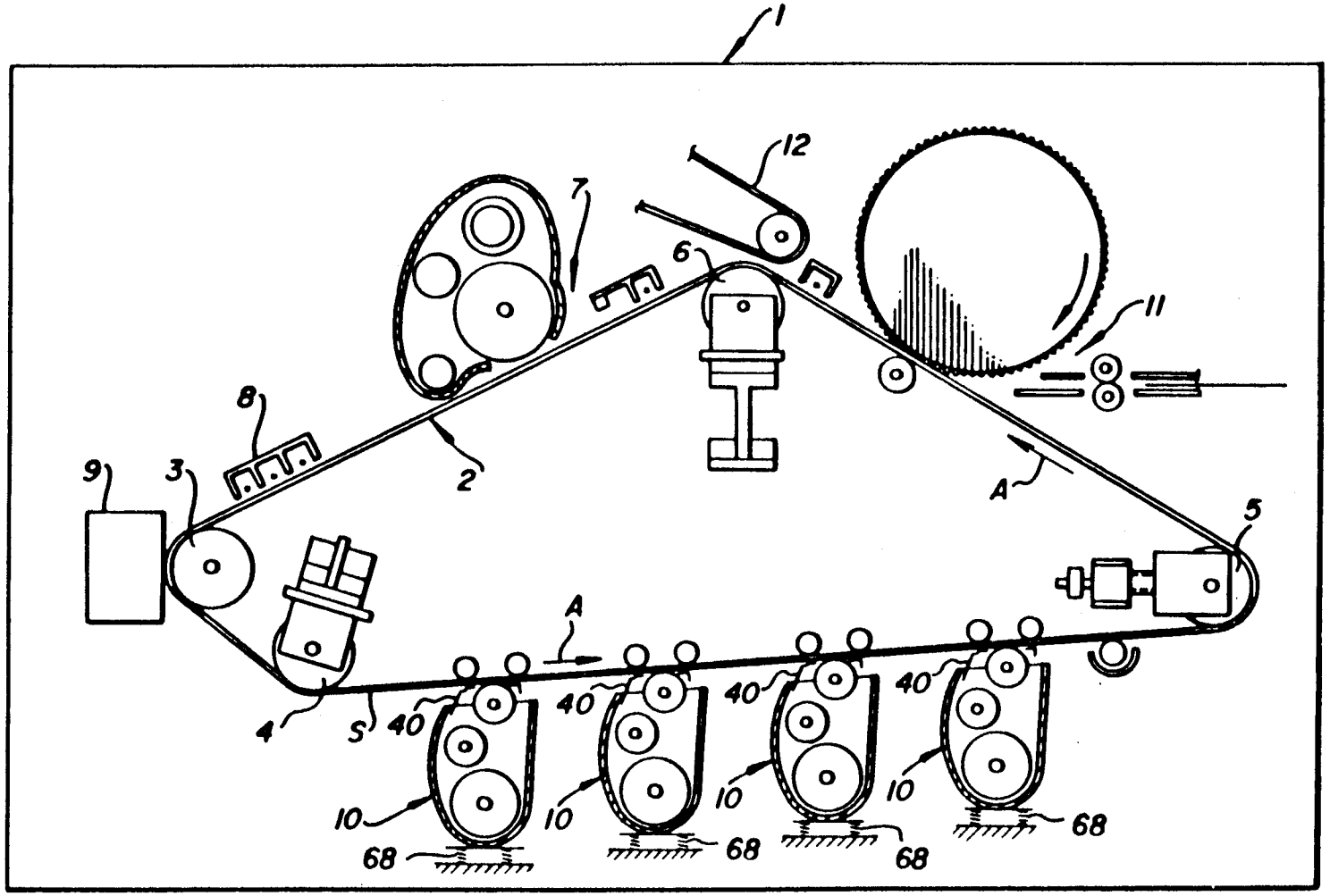
FIG. 1 is a schematic view of an electrostatographic reproduction apparatus such as a copier or printer including the development apparatus of the present invention.

Referring now to the accompanying drawings, FIG. 1 shows an electrostatographic reproduction apparatus such as a printer 1. The apparatus 1 can, of course, also be a copier/duplicator. As shown, the apparatus 1 includes an endless flexible image-bearing member or film 2 that is trained for movement in the direction of the arrow A about a series of rollers 3, 4, 5 and 6, one of which is a drive roller.

As is well known, copies of original documents and/or prints of documents can be produced on the printer or copier 1 according to the electrostatographic process. For such process, each moving portion of the image-bearing surface S of the image-bearing member 2, is (a) cleaned at a cleaning station 7, (b) uniformly charged at a charging station 8, and (c) then imagewise exposed at an exposure station 9. The exposure station 9 is shown as an electronic printhead but can equally consist of appropriate optical means as is well known.

Latent images or imagewise charge patterns formed at the exposure station 9 are next developed with toner particles at a development station or apparatus of the present invention designated generally as 10. A plurality of the development apparatus 10 is shown in FIG. 1 and, as such, can be used in producing multiple-color copies or prints. The toner developed image next moves to a transfer station 11 where it is transferred to a suitable receiver sheet which is thereafter separated from the image-bearing member 2 and then transported to a fusing apparatus (not shown) by transport means shown as 12.

Figure 2:
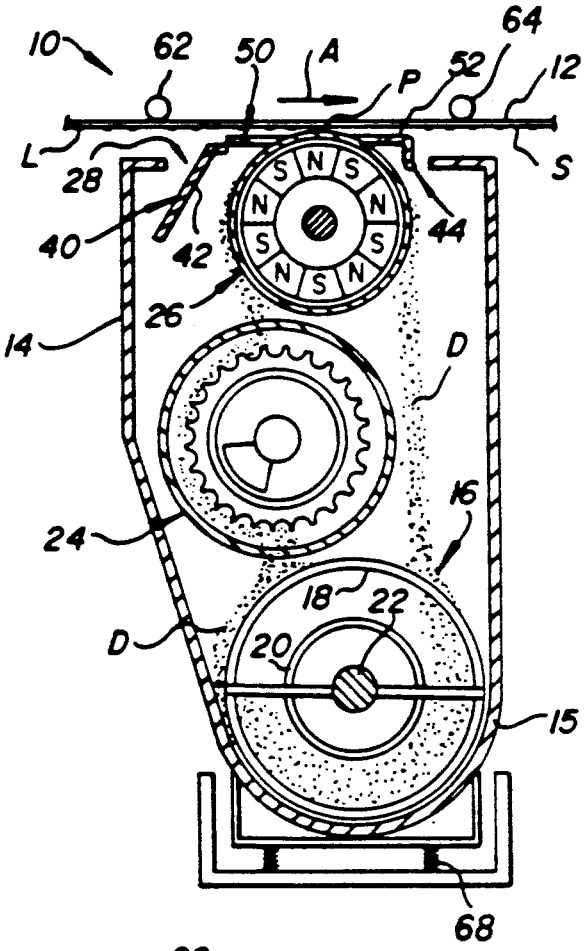
FIG. 2 is a schematic front end sectional view of the development apparatus of the present invention.

Referring now to FIG. 2, the development apparatus of the present invention 10 is shown. The development apparatus 10 is a magnetic roller-type apparatus and is mountable in the electrostatographic copier or printer 1. As described above, the image-bearing member 2 of the printer 1 is movable in the direction, for example, of the arrow A relative to the development apparatus 10. As shown, the apparatus 10 is adapted to supply developer material D, containing marking or toner particles, for developing latent charge images L on the image-bearing surface S of the member 2. The latent images L may be composed, for example, of negative charges laid down at the charging station 8.

The development apparatus 10 comprises a housing 14 having a sump portion 15 for holding a supply of the developer material D. Developer material D consists, for example, of small hard magnetic carrier particles and of fusable marking or toner particles. The carrier and toner particles are chargeable triboelectrically by means of a rotatable ribbon blender 16 mounted in the sump portion 15. The carrier particles, for example, may be charged negatively, and the toner particles positively.

The ribbon blender 16 may comprise an outer helical ribbon 18 and an inner helical ribbon 20. Both inner and outer ribbons are coiled concentrically about, and movable by, a driven shaft 22. Movement of the ribbons 18 and 20 agitates the carrier and toner particles as well as moves them for delivery to a feed mechanism shown as 24. As shown, the feed mechanism 24 is located between the ribbon blender 16 and a magnetic brush or development roller means 26. Feed mechanism 18, as located, receives and feeds the charged carrier and toner particles to the magnetic development roller 26 which is located at the top of the housing 14 within an opening 28 therein.

The development roller 26 may be of any suitable construction, and can include a non-magnetic shell 30 as well as a magnetic core 32. The shell 30 is rotatable in a counterclockwise direction, as shown by the arrow B, about the core 32. The core 32 consists of a plurality of permanent magnets which are arranged in an alternating N–S pole pattern, and which can be rotated, for example, in a clockwise direction as indicated.

As shown in FIG. 2, a portion of the development roller 26 projects through the opening 28 in the top of the housing 14 such that when the apparatus 10 is properly mounted in a copier or printer, the projecting portion will lie directly adjacent, or within a desired proximity to the latent images L on the surface S of the flexible image-bearing member 2. The proximity should be such that toner particles will be transferred to the negative-charge images L when developer material D consisting of negatively-charged carrier particles and positively-charged toner particles is transported on the magnetic roller 26 past such negative charge images L on the surface S. Such transfer of toner particles represents the development step of the electrostatographic process.

Such development occurs within a region or development nip indicated, for example, as P. The region P should lie centrally within the opening 28, FIGS. 2 and 3. During such development, the transfer of charged toner particles from the developer material D to the images L on the surface S as described above is desirable. Unfortunately, however, some of the carrier particles (referred to as DPU or developer pickup) undesirably also transfer to the surface S. This undersirable transfer of carrier particles is particularly serious when the carrier particles consist of small, hard and unfusable magnetic particles. In copiers and printers, DPU particles, in general, will result in finished image defects if left on the image-bearing surface and subsequently transferred at the transfer station 11 to a copy sheet or receiver.

In the present invention, in order to assure the quality of finished copies by recapturing such DPU particles, an internal scavenging device 40 is provided within the development apparatus 10. The scavenging device 40 operates to recapture, from the image-bearing surface S (and within the development apparatus 10), the unwanted carrier particles (DPU) which undesirably transferred thereto during toner image development.

Figure 3:
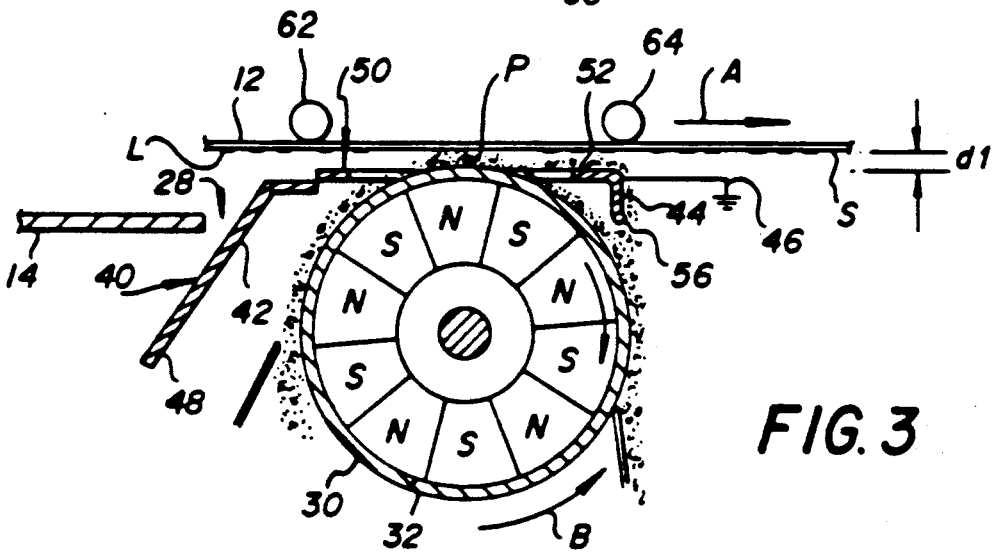
FIG. 3 is an enlarged schematic, partly in section, of the magnetic development roller and scavenging device of the present invention.

As illustrated in FIG. 3, the scavenging device 40 comprises a first non-magnetic plate member 42, a second non-magnetic plate 44, and electrical biasing means 46. The plates 42, 44 are stiff and may, for example, be made of stainless steel. As shown, the first plate 42 includes a first portion 48 which is angled relative to the top of the housing 14, as well as to the opening 28 therein, and a second portion 50 which is parallel to the opening 28. The plate 42 is mounted by suitable means to the front and rear end walls (not shown) of the housing 14 such that the second portion 50 thereof will lie between the image-bearing surfaces and the development roller 26, as well as be spaced a precise small distance d1 from the frontsides of the image-bearing member 2. The entire device 40 is lightweight, and because it is made of non-magnetic stainless steel, for example, it is structurally stiff, and hence, will ordinarily retain its precise spacing from the surface S all the way from the front to the rear of the development apparatus 10. There is, therefore, no significant sagging, for example, at its middle.

The second portion 50 of the first plate 42 includes a significantly large flat surface area 52, as well as a development aperture 54. The second portion 50 of the plate 42, as shown, fits within the opening 28, and the development aperture 54 therein thus lies within and is smaller than the opening 28. The aperture 54 is substantially coincident with the width of the development nip P. As such, developer material D transported by the magnetic development roller 26, when moved through the opening 28, will also be moved through the aperture 54 and so will come into a toner particle-transfer relationship, within the nip P, with latent images L on the surface S.

The flat surface area 52 of the second portion 50 of plate 42 is located so as to be downsteam of the aperture 54 and, hence, also downstream of the development nip P. The area 52 is useful for exposing the surface S to a DPU recapture electrical field generated by the biasing source 46. The electrical biasing source 46 is preferably a DC source and should have a polarity opposite to that of the charged carrier particles comprising the DPU particles to be recaptured. For example, in a development apparatus utilizing negatively-charged carrier particles, a positive potential should be applied for attracting and recapturing, from the surface S, unwanted negatively-charged DPU particles.

As shown, the second plate 44 is connected to the area 52 and includes a free edge 56 positioned within the magnetic field of the development roller 26. As such, carrier or DPU particles recaptured onto the area 52 will gravitationally and magnetically be pulled down to the edge 56 and over to the roller 26 for return to the sump portion of the apparatus 10.

In the present invention, besides assuring the quality of finished copies by recapturing carrier particles (DPU) from the surface S, the effectiveness and quality of toner image development within the nip P is also assured by precisely and responsively spacing the development roller 26 from the image-bearing surface S. Accordingly, the development apparatus 10 includes a spacing mechanism designated generally as 60 (FIG. 4) for precisely and responsively spacing the development roller 26 from the surface S.

Referring now to FIGS. 1, 2 and 4–5, the spacing mechanism 60 includes first and second backup rollers or ski rods 62, 64 for forming a plane 66 for the image-bearing member or film 2. The film plane 66 is generally parallel to a plane that is tangential to the development roller 26. The backup rollers or ski rods 62, 64 are mounted within the copier or printer 1 such that they are side-by-side from each other and so that they lie across from the development roller 26 as well as in contact with the backside of the image-bearing member or film 2.

Figure 4:
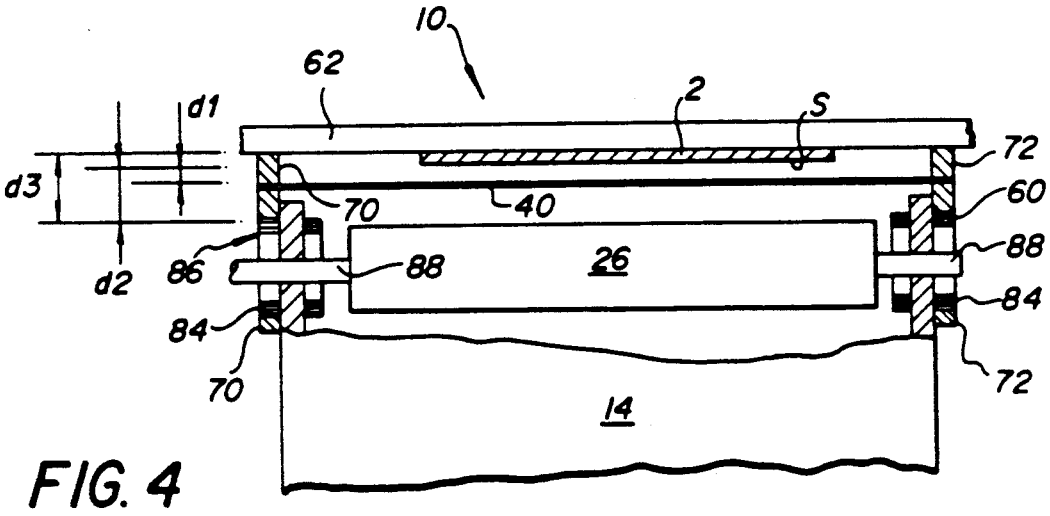
FIG. 4 is a side view, partly in section, of part of the spacing mechanism of the present invention.
Figure 5:
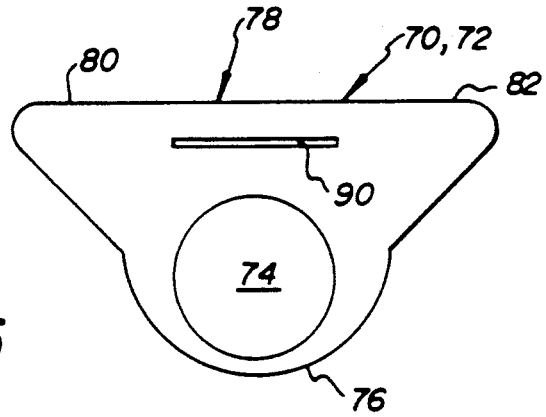
FIG. 5 is a schematic of the triangular member of the present invention.
Figure 6:
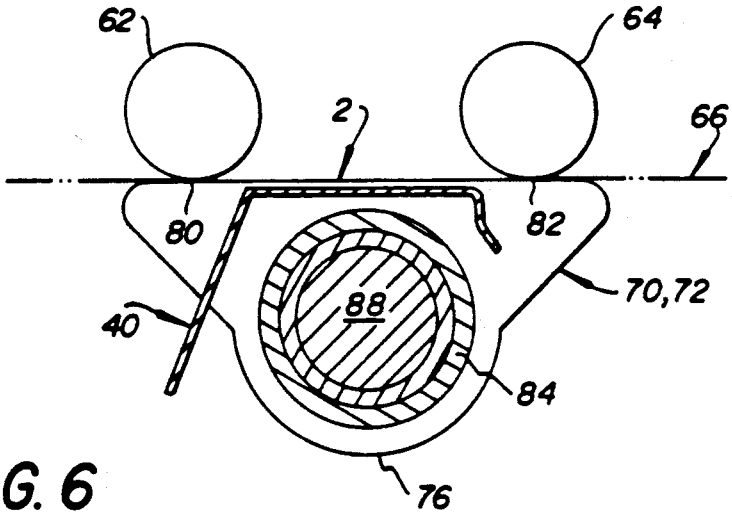
FIG. 6 is an end view schematic showing the triangular member of FIG. 5 as mounted in the present invention.

As shown in FIGS. 1 and 2, the spacing mechanism 60 further includes spring means 68 connected to the frame of the copier or printer 1 for supporting the development apparatus 10 urgeably toward or away from the frontside S of the film 2. The spacing mechanism 60 also includes a pair of generally triangular members 70, 72 for precisely spacing the development roller 26 from the first and second backup rollers or ski rods 62, 64. As shown in FIGS. 4–6, each triangular member 70, 72 includes a mounting aperture 74 toward its apex 76 for mounting to an end of the development roller 26. The base 78 of each triangular member 70, 72 further includes portions 80, 82 for simultaneously contacting and riding on both the first and second backup rollers or ski rods 62, 64.

Referring to FIG. 4, each triangular member 70, 72 is keyed by means of the mounting aperture 74 to the outer race 84 of a bearing 86. The bearing 86 can be a second bearing supporting the driven shaft 88 of the development roller 26. As keyed, the triangular member 70, 72 is movable pivotally with the outer race 84 relative to the development roller shaft 88. Each triangular member 70, 72 is, therefore, similarly movable relative to the surface of the development roller 26.

As described above, the triangular members 70, 72 are useful for mounting a carrier particle (DPU) scavenging device 40 at a precise small distance d1 from the image-bearing surface S. Accordingly, for mounting the device 40, each triangular member 70, 72 includes a mounting slot 92 formed between the base 78 and apex 76 thereof. A scavenging device 40 mounted therein will move with the triangular members 70, 72 responsively to any movement of the film 2 caused, for example, by a skew or variation in the normal alignment of the backup rollers or ski rods 62, 64.

As shown in FIG. 4, when set up, the scavenging device 40, as described above, should be spaced precisely the small distance d1 from the surface S. The surface S on which the latent image L (FIG. 2) are to be developed should be, in turn, spaced a precise distance d2 from the surface of the development roller 26. To initially ensure such precise distances d1, d2, each triangular member 70, 72 is designed with the slot 90 therein such that when keyed to the bearing 86, as shown, the backup rollers or ski rods 62, 64 will be spaced a desired distance d3 from the surface of the development roller 26. As described above, the distance d3 is achieved, as such, against the force of the spring means 68 so as to cause the triangular members 70, 72 to move responsively to any movement in the backup rollers or ski rods 62, 64. As such, the triangular members 70, 72 will pivot responsively so that the film plane 66 formed by the rollers or rods 62, 64 will constantly be parallel to, and be precisely spaced from, a plane tangential to the development roller 26, thereby assuring constant uniform and high quality image development within the nip P (FIGS. 2 and 3).

As can be seen, in order to assure uniform high quality development in a copier or printer 1 having a flexible image-bearing member or film 2, the mechanism 60 is provided. The mechanism 60 with each development apparatus 10 precisely and responsively spaces the development roller 26 of such development apparatus from the surface S of the image-bearing member. The mechanism 60 includes a pair of triangular members 70, 72 which have means 92 for responsively mounting a scavenger device 40 at a precise small distance d1 from the surface S. The scavenging device 40 further assures the quality of the final copy by effectively recapturing from the surface S any nonfusable carrier particles (DPU) undesirably transferring to the surface S during toner image development.

The invention has been described in detail with particular reference to a presently preferred embodiment, but it will be understood that variations and modifications can be effected within the spirit and scope of the invention.

What is claimed is:

1. In an electrostatographic copier or printer having a flexible image-bearing member or film for electrostatically forming latent images on a frontside thereof, and a development apparatus positioned adjacent the frontside of the film and including a development roller for developing such latent images with toner particles, a spacing mechanism for responsively and precisely spacing the development roller from such frontside of the film, the spacing mechanism including:

(a) first and second backup rollers or ski rods for forming a film plane generally parallel to a tangential plane to the development roller, said first and second ski rods being mounted spaced side-by-side from each other in contact with a backside of the film, and across from the development roller or the development apparatus;

(b) spring means connected to a frame of the copier or printer for supporting the development apparatus urgeably toward or away from the frontside of the film; and (c) a pair of generally triangular members, precisely spacing the development roller from said first and second ski rods, each said triangular members being mounted at an end of said development roller, and each said triangular members, as mounted, acting against a force of said spring means and simultaneously contacting said first and second ski rods, for moving said development roller responsively to any movement of said first and second ski rods and, hence, responsively to movement of the frontside of the film or image-bearing member.

2. The mechanism of claim 1 wherein each said triangular members includes means at an apex thereof for mounting to an end of said development roller.

3. The mechanism of claim 1 wherein each said triangular members is movable pivotally relative to said development roller in response to movement of said contacting ski rods.

4. The mechanism of claim 1 wherein each said triangular member includes means between a base and apex thereof for mounting a scavenger device having a precise spacing from said development roller and said film plane.

5. The mechanism of claim 2 wherein the base of each triangular member includes means for simultaneously contacting and riding on said first and second ski rods.

6. The mechanism of claim 2 wherein each said triangular members is mounted by keying a mounting aperture in said apex to the outer race of an inner and outer race bearing at each such end of said development.

7. In an electrostatographic copier or printer having a flexible image-bearing member or film trained about a plurality of rollers, including first and second backup rollers or ski rods, for electrostatically forming latent images on a frontside of such film, a development apparatus for developing such latent images with toner particles, the development apparatus including:

(a) a housing having front and rear end walls, and a sump portion for holding developer material, including such toner particles;

(b) means including a compressible spring for supporting said housing such that a top portion thereof is positioned adjacent the frontside of the image-bearing member or film;

(c) a rotatable development roller for applying the toner particles to the latent images, said development roller being mounted in said top portion of said housing and having a precise spacing from said frontside of the image-bearing member;

(d) means located in said sump portion of said housing for mixing the developer material therein;

(e) means for moving and feeding the developer material from said sump portion to said development roller; and (f) a pair of generally triangular members, precisely spacing the development roller from said first and second backup rollers or ski rods, each said triangular members being mounted to an end of said development being mounted to an end of said members, as mounted, acting against a force of said compressible spring, and simultaneously contacting said first and second backup rollers so as to move said development roller precisely and responsively to any movement of said first and second backup rollers and, hence, of the frontside of the image-bearing member.

8. The development apparatus of claim 7 wherein each said triangular members is movable pivotally relative to the development roller.

* * * * *

UNITED STATES PATENT AND TRADEMARK OFFICE

CERTIFICATE OF CORRECTION

PATENT NO. : 5,066,981

DATED : November 19, 1991

INVENTOR(S) : Satyan R. Kalyandurg

It is certified that error appears in the above-identified patent and that said Letters Patent is hereby corrected as shown below:

Column 8, Claim 7, line 49, after "development" delete "being mounted to an end of said" and insert --roller, and each said triangular--.

Signed and Sealed this

Twenty-fifth Day of May, 1993

*Attest:*

Michael K. Kirk

MICHAEL K. KIRK

*Attesting Officer*

*Acting Commissioner of Patents and Trademarks*